US005296178A

United States Patent [19]

Sugihara et al.

[11] Patent Number: 5,296,178

[45] Date of Patent: Mar. 22, 1994

[54] METHOD OF MAKING A MOLD BY SPRAYING METAL USING A PARTICULATE MOLD RELEASE AGENT

[75] Inventors: Kazuyuki Sugihara, Okayama; Nobuhiko Yukawa, Hyogo, both of Japan

[73] Assignees: Chugoku Kako Co., Ltd., Kurashiki; Nippon Shokubai Co., Ltd., Osaka, both of Japan

[21] Appl. No.: 817,626

[22] Filed: Jan. 7, 1992

[51] Int. Cl.[5] ..... B28B 11/06

[52] U.S. Cl. ..... 264/130; 264/131; 264/226; 264/227

[58] Field of Search ..... 264/130, 131, 225, 226, 264/227, 135, 338

[56] References Cited

U.S. PATENT DOCUMENTS

| | | | |
|---|---|---|---|
| 2,250,246 | 7/1941 | Axline et al. | 264/225 |
| 3,228,650 | 1/1966 | Gilliard et al. | 249/135 |
| 3,405,212 | 10/1968 | Fraser et al. | 264/226 |
| 3,631,745 | 1/1972 | Walkey et al. | 264/225 |
| 3,811,175 | 5/1974 | Garner et al. | 264/227 |
| 3,816,903 | 6/1974 | Garner | 264/225 |
| 4,231,982 | 11/1980 | Jansson | 264/338 |
| 4,777,002 | 10/1988 | Pütz | 264/338 |

FOREIGN PATENT DOCUMENTS

| | | | |
|---|---|---|---|
| 54-133834 | 10/1979 | Japan | 264/225 |
| 55-3444 | 1/1980 | Japan | 264/131 |
| 55-30951 | 3/1980 | Japan | 364/130 |
| 58-62011 | 4/1983 | Japan | 264/227 |
| 60-121022 | 6/1985 | Japan . | |
| 61-61891 | 12/1986 | Japan . | |
| 63-6327 | 2/1988 | Japan . | |
| 2-23331 | 5/1990 | Japan . | |
| 2-54422 | 11/1990 | Japan . | |
| 935110 | 8/1963 | United Kingdom | 264/225 |
| 1167690 | 10/1969 | United Kingdom | 264/225 |

OTHER PUBLICATIONS

Patent Abstracts of Japan, vol. 014, No. 514 (M-1046), Nov. 13, 1990 & JP-A-22 14 618 (Nippon Shokubai KK), Aug. 27, 1990 (Abstract).

Patent Abstracts of Japan, vol. 012, No. 218 (M-711), Jun. 22, 1988 & JP-A-63 017 029 (Nippon Shokubai KK), Jan. 25, 1988 (Abstract).

Patent Abstracts of Japan, vol. 004, No. 045 (M-006), Apr. 9, 1980 & JP-A-55 015 886 (Nakagawa Kogyo KK), Feb. 4, 1980 (Abstract; figures).

*Primary Examiner*—Jay H. Woo
*Assistant Examiner*—Robert B. Davis
*Attorney, Agent, or Firm*—Armstrong, Westerman, Hattori, McLeland & Naughton

[57] ABSTRACT

A method including: based on a primary mold having a surface pattern identical with that of a composition to be produced, making a secondary mold having a low melting point sprayed metal layer of Zn or the like to which the surface pattern of the primary mold is transferred; next, after carrying out mold-releasing treatment on the secondary mold surface, spraying a high melting point metal such as Ni or the like; reinforcing the back side of the thus-formed high melting point sprayed metal layer with FRP or the like; hardening said FRP or the like; and then, releasing a composition consisting essentially of the high melting point sprayed metal layer and the reinforcing resin layer from the secondary mold.

3 Claims, 4 Drawing Sheets

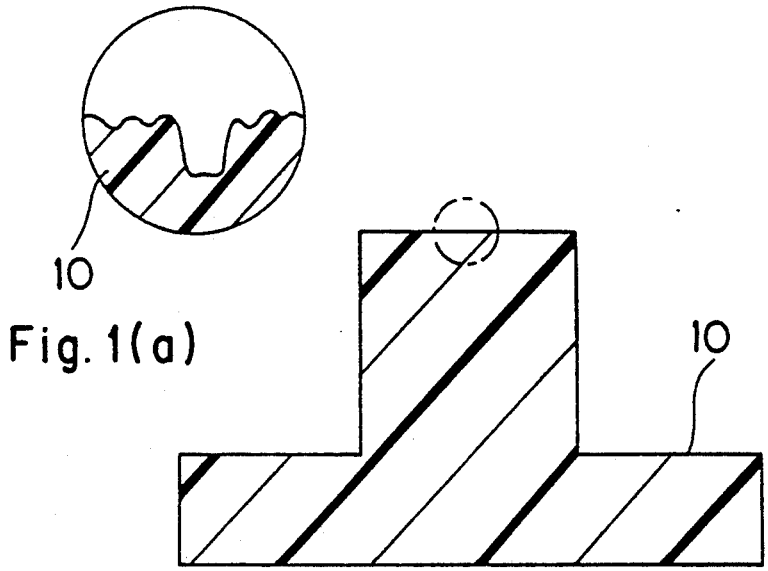
Fig. 1(a)
Fig. 1
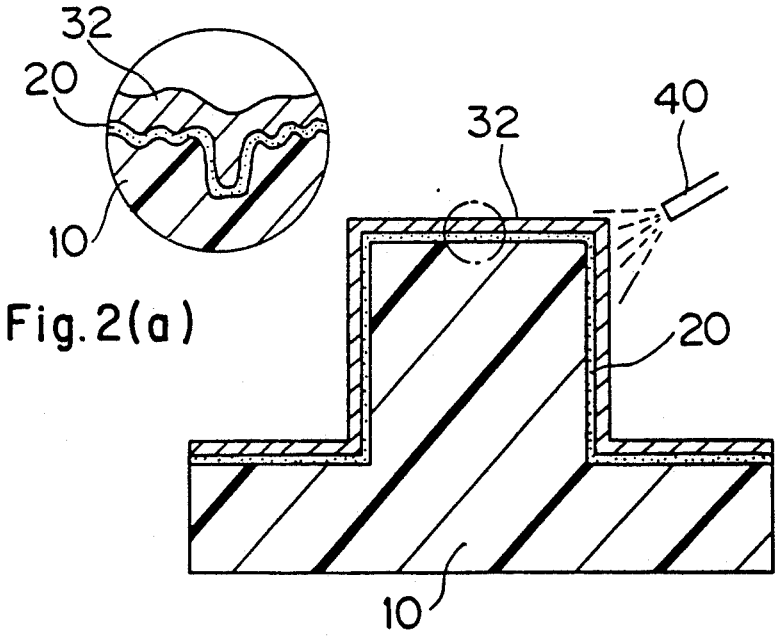
Fig. 2(a)
Fig. 2

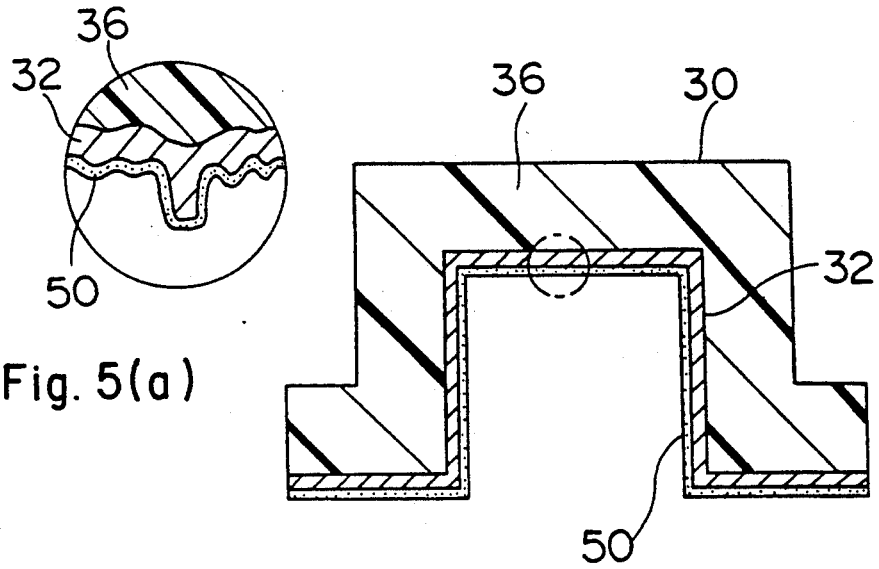
Fig. 5(a)
Fig. 5
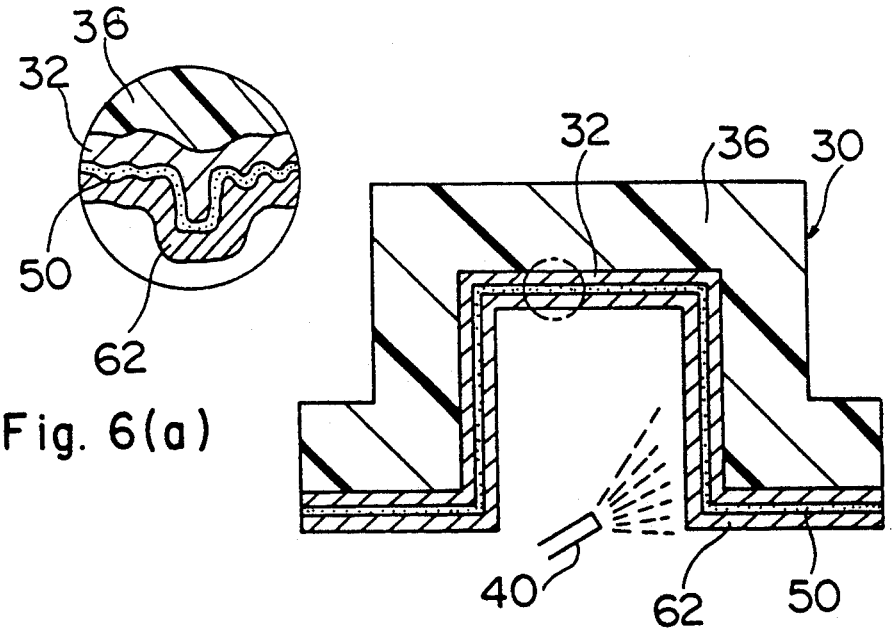
Fig. 6(a)
Fig. 6

METHOD OF MAKING A MOLD BY SPRAYING METAL USING A PARTICULATE MOLD RELEASE AGENT

BACKGROUND OF THE INVENTION

This invention relates to a composition having a hard metal surface formed by metal spraying, wherein the back side is reinforced by fiber-reinforced plastics and so on, a method for producing thereof, and a mold release agent used in the producing method. The composition is intended for works of art or ornaments such as a relief or a statue which presents a metallic appearance, or flooring materials which requires abrasion resistance, or a mold for molding resin.

The fiber-reinforced plastics (referred to as FRP hereinafter) being light and strong, and having superior heat resistance and weather resistance have been widely accepted in a field where metal materials were used previously. However, the surface of FRP is not so hard in comparison with that of metals or the like. Consequently, if the FRP is used for purposes requiring high surface durability, for example, flooring materials, a mold for molding a resin, or the like, the FRP is inclined to become not suitable because of its surface cracks or abrasion. Therefore, improvement of such a defect has been desired.

Also, in the field of works of art, it has been adapted that the surface of an article comprising FRP or non-fibrous resin is metal-sprayed to form a metal layer providing a metallic appearance. In this case, however, the polishing process is needed to render the roughly sprayed surface smooth and shiny. Therefore, when a finely rugged pattern is required on the metal surface, an additional process such as machining by hand engraving or the like after the polishing is essential, which takes a lot of time and technique. Here, in this specification, "a (finely) rugged pattern" means a pattern made by (fine) unevenness.

In order to overcome the above noted problem, various procedures have been devised heretofore. One known arrangement, for example Japanese Official Patent Provisional Publication, Showa 60-121022 discloses that the surface of an original mold made of wood or gypsum is coated with a mold release agent comprising such as PVA resin. After that, the mold is sprayed with such metals as Zn or Zn-Al alloy being comparatively soft and having a low melting point. The back side of the sprayed metal layer is reinforced by a reinforcing layer comprising FRP or the like. Thus obtained composition consisting of the sprayed metal layer and the reinforcing layer is released from the original mold. Thus, the pattern of the surface on the original mold is transferred onto the surface of the sprayed metal layer on the composition. The above procedure makes it possible precisely to transfer the finely rugged pattern of the original mold onto the surface of the sprayed metal layer and to increase the surface hardness which has been a defect of the FRP.

However, the above Zn or the like which has been commonly used for metal spraying is suitable for transfer of the original mold surface pattern by means of metal spraying, but not hard enough to maintain abrasion resistance. Therefore, they are undesirable when used for various uses such as a mold which requires mechanical strength and other characteristics. Then, metals such as nickel, the stainless steels or the like which have superior characteristics have been desired to be used as a metal for spraying.

However, there is a problem that nickel or the stainless steel having a high melting point does not adhere to the surface of the mold even if these metals are sprayed. Also, there is a defect that the finely rugged pattern formed on the original mold cannot be precisely transferred and that the reproduction of the rugged pattern is bad.

Various methods have been devised heretofore to produce a superior composition comprising a sprayed metal layer and the FRP by means of above transfer process utilizing the high melting point metals such as nickel or the stainless steels.

For example, it is known that if minute uneveness is formed on the original mold surface by the blast processing or the like, adhesion of the high melting point sprayed metal layer is improved.

Japanese Official Patent Gazette, showa 61-61891 discloses the following procedure. At first, a mold is made of wood or gypsum. Then an inversion mold of said mold is formed with heat resisting resin such as silicone rubber. Utilizing the inversion mold, a secondary mold having the same shape as that of the original is made by precisely casting antimony or the like which is not apt to expand and has low melting point. After positioning pins made of high melting point metal on the surface of the secondary mold, high melting point metal is sprayed and the back side thereof is reinforced with silica sand. After removing the pins and secondary mold by using melting fusion process, the inversed surface pattern of the original mold is obtained on the surface of the high melting point sprayed metal layer. In this case, the pins placed in the secondary mold of low melting point metal improve adhesion of high melting point metal.

Japanese Official Patent Gazette, showa 63-6327 discloses that after applying a surface treatment to a mold made of a material to be easily processed such as wood, plastics or the like by using a surface treatment agent containing water-soluble adhesive such as water glass or the like and red iron oxide as main components, then nickel or chromium is sprayed by cold metal spraying. Here, in this specification, "cold metal spraying" means a method wherein the mold temperature does not become high even if a hot metal melted under high temperature is sprayed on the mold. On the metal layer formed by this cold metal spraying, the surface pattern of the original mold is transferred. The surface treatment agent makes it easy to release the metal layer from the mold, and the cold metal spraying enables use of a non-heatproof mold.

Japanese Official Patent Gazette, heisei 2-23331 discloses that the silicone elastomer containing a fireproof filling agent such as quartz is used as surface materials of the mold. The fireproof filling agent is used to prevent damage caused by the heat during metal spraying.

The Japanese Official Patent Gazette, heisei 2-54422 discloses that in case of spraying a metal directly on the product substrate, the product substrate previously coated with resin containing minute particles is metal sprayed to improve adhesion of the sprayed layer.

However, above mentioned prior art procedures are not sufficient to improve adhesion of the high melting point sprayed metal securely and to reproduce the surface pattern of the original mold.

For example, in the method comprising forming a minute unevenness uniformly on the entire surface of the original mold by blast processing etc., in case that there is a finely rugged pattern on the original mold, this finely rugged pattern is erased and the finely rugged pattern cannot be transferred on the surface of the high melting point sprayed metal layer. Therefore, in this case, a further processing by hand engraving or etching is required to make the rugged pattern on the surface of the high melting point sprayed metal layer obtained. As a result, labor and cost for processing are consumed. Also, in such an additional processing, it is impossible to reproduce the very same finely rugged pattern as that of the original mold, and scattering of finished quality is large. Furthermore, if the blast processing is carried out, it is impossible to finish the high melting point sprayed metal layer surface into the specular one. Therefore, in case of necessity of a specular surface for the product surface, it is required to carry out an additional processing for making a specular surface by means of grinding etc.

The procedure cited in Japanese Official Patent Gazette, showa 61-61891 requires removal of the pins and elimination of the pin traces by means of grinding. Therefore, the finely rugged pattern cannot exist around the setting place of the pin. Grinding of the pin trace may eliminate also the original pattern. At the position distant from the pin setting places, adhesion cannot be improved. This procedure requires the aforementioned blast treatment and cause the same problem stated above. Also in this procedure, the secondary mold formed by precise casting of antimony or the like is sprayed with high melting point metal. The precise casting requires the extremely high technology and a long term treatment. Furthermore, in order precisely to cast the secondary mold, additional processes and time are required to make an inversed mold of heatproof material such as silicone rubber in accordance with the original mold of gypsum.

According to the procedure cited in Japanese Official Patent Gazette, showa 63-6327, the cold metal spraying method is adopted because of using the material such as wood or gypsum which are readily processed but not heatproof. In the cold metal spraying method, the surface of the high melting point sprayed metal layer formed becomes roughly uneven like that of the ground glass. Therefore, even if a finely rugged pattern is formed on the original surface, the finely rugged pattern cannot be transferred on the high melting point sprayed metal layer. The above prior art provides that metal being readily processed and having a low melting point may be utilized as the original mold. However, such an original mold has the same problem stated above as for Japanese Official Patent Gazette, showa 61-61891 concerning time and cost.

Regarding the procedure cited in Japanese Official Patent Gazette, heisei 2-23331, high melting point metal layer cannot be finely formed because mold characteristics and mechanical strength of silicone elastomer to be sprayed with the high melting point metal is inferior to that of metal mold or the like. Therefore, it is desirable to make the elastomer surface rough or to spray the low melting point metal such as Zn/Al alloy thinly on the elastomer surface in order to improve adhesion of the high melting point sprayed metal layer. However, if the silicone elastomer surface is made to be rough, a finely rugged pattern disappears. When the low melting point metal is sprayed on the surface of the silicone elastomer, the surface of the low melting point metal becomes irregularly uneven, so that the original mold's finely rugged pattern is buried and disappears. Also, if the high melting point metal is sprayed directly on the surface of the low melting point sprayed metal layer, when the high melting point metal layer is mold-released from the silicone elastomer surface, the sprayed layer of the low melting point metal remains adhering to the surface of the high melting point sprayed metal layer, so that a product having the high melting point sprayed metal layer on the surface cannot be obtained.

The procedure provided in Japanese Official Patent Gazette, heisei 2-54422 improves adhesion of a sprayed metal layer to the substrate, but it is difficult to release the sprayed metal layer from the substrate. Therefore, it is not adoptable for transferring the original mold surface pattern to the sprayed metal layer by releasing the sprayed metal layer from the original mold after the sprayed metal layer is formed on the original mold surface.

SUMMARY OF THE INVENTION

Accordingly, it is an object of the present invention to provide a composition comprising a high melting point sprayed metal layer and a reinforcing resin layer, which is superior in the surface pattern and characteristics and resolves the above problems of the prior art.

It is a further object of the present invention to provide a suitable method for producing said composition, which improves adhesion of the high melting point sprayed metal layer and reproduction of the original mold's surface pattern including a finely rugged pattern, a specular surface, or the like.

It is yet another object to provide a mold release agent utilized in the above method to enhance the effects.

A composition having a sprayed metal layer, which solves said problems and relates to the present invention, is the one consisting essentially of a metal layer made by metal spraying and a resin layer which reinforces the sprayed metal layer from the back side. Said metal layer is composed of a high melting point metal having a melting point of 1000° C. or higher, and on the surface of this high melting point sprayed metal layer, a finely rugged pattern identical with that of the surface of an original production mold is transferred.

Also, a method for producing a composition having a sprayed metal layer, which relates to the present invention, is a method for producing a composition consisting essentially of a metal layer made by metal spraying and a resin layer which reinforces said metal layer from the back side, comprising:

making a primary mold having a surface pattern identical with that of a composition to be produced; next, based on this primary mold, making a secondary mold, which has a sprayed metal layer consisting essentially of a low melting point metal on the surface and, which comprises transferring the surface pattern of the primary mold to the low melting point sprayed metal layer;

carrying out mold-releasing treatment on the surface of the secondary mold and then, spraying a high melting point metal having a melting point of 1000° C. or higher;

reinforcing the back side of the thus-formed high melting point sprayed metal layer with a resin layer;

hardening said resin layer; and releasing a composition consisting essentially of the high melting point sprayed metal layer and the reinforcing resin layer from the secondary mold.

The primary mold precisely represents the surface pattern of a composition to be produced so far as the finely rugged pattern or the like. Materials such as wood, gypsum, resin or metal which can be readily processed so as to produce the finely rugged pattern are utilized when making the primary original mold. The surface of natural materials such as crushed surface of the natural stone or the grain of wood may be directly used as surface of the primary mold. By etching treatment on the surface of metal materials, the pattern of leather skin, stitch, or suede can be made, or the grain of wood or the like can be brought into relief. In the present invention, the finely rugged pattern on the surface of the primary mold can be precisely reproduced on the surface of the composition. Depth or height and width of the unevenness of the finely rugged pattern depend on the objects or the design of the composition. In this invention, however, the finely rugged pattern can be precisely reproduced on the composition surface even when the height or depth of unevenness is 50 μm or less, and the width is 50 μm or less.

The secondary mold having a low melting point sprayed metal layer on the surface to which the surface pattern of the primary mold is transferred is made from the primary mold under the standard transfer method. The detailed producing conditions are disclosed in Japanese Official Patent Provisional Publication, showa 60-121022 and others.

On the primary mold surface, it is desirable to make metal spraying after the mold-releasing treatment. This mold-releasing treatment involves releasing the sprayed metal layer from the primary mold easily as well as making the sprayed metal layer adhere to the surface of the primary mold securely so as to obtain a superior sprayed metal layer. Commonly used mold release agent or mold-releasing treatment may be adopted. For example, an aqueous PVA solution, silicon despersed into solvent, or the like may be used as a mold release agent, and coating means such as spray coating or the like can be adopted.

Alloy containing zinc, lead, tin, or the like as a main component, or a simple metal substance may be used as a low melting point metal.

Since such a low melting point metal is soft, the metal can adhere to the surface of the primary mold securely, and even the finely rugged pattern can be precisely transferred onto the surface of the metal layer. Metal spray coating devices and conditions may be similar to those in usual metal spraying methods. Preferable thickness of the sprayed metal layer is 25–200 μm. When the thickness is less than 25 μm, the sprayed layer may have gaps and its adhesion to the high melting point sprayed metal layer stated later becomes bad. When the thickness exceeds 200 μm, it may unfavorably cause deformation by heat without improving the effects for objects.

As for the particle diameter of the metal particles to be sprayed, the smaller the better to transfer the finely rugged pattern precisely. It is desirable that the particle diameter of the metal particles to be sprayed is around a few μm to 100 μm by adjusting the air pressure or the like while metal spraying.

A reinforcing layer such as FRP or the like is formed on the back side of the low melting point sprayed layer formed along the surface of the primary mold. A simple resin layer not containing a reinforcing fiber, or any other reinforcing material which is used for the standard FRP can be utilized for the reinforcing layer. In the present invention, the use of the following FRP is desirable.

The FRP comprises a thermosetting resin and a reinforcing fiber. As for a thermosetting resin, a commonly used resin material for FRP such as an epoxy resin, an unsaturated polyester resin or the like is utilized. As for a reinforcing fiber, commonly used fiber material for FRP such as glass fiber, carbon fiber, polyamide fiber or the like can be utilized. In order to reproduce the size of the primary mold precisely to the secondary model, the combination of an epoxy resin and a carbon fiber is desirable. In case of attaching importance to the operation efficiency, the combination of a glass fiber and an unsaturated polyester resin is desirable.

The thermosetting resin and reinforcing fiber are laminated and hardened on the back side of the aforementioned low melting point sprayed metal layer by means of usual methods. If necessary, at this stage, reinforcing materials such as iron frames may be installed to prevent an entire warp and deformation. After hardening the resin, the secondary mold comprising the FRP layer and the low melting point sprayed metal layer is released from the primary mold.

The secondary mold obtained is sent to the next final stage for producing a composition after, if necessary, removing the remaining mold release agent such as PVA or the like from the surface.

Spraying of a high melting point metal is carried out to the secondary mold surface, but before it, the mold-releasing treatment should be applied to the secondary mold surface.

The low melting point sprayed metal layer has much better adhesion of the high melting point sprayed metal layer than the mold composed of gypsum, a resin or the like. However, if the mold-releasing treatment is carried out, further superior adhesion is attained and also, superior mold-releasing property is displayed when the high melting point sprayed metal layer is released from the mold.

As for the mold-releasing treatment, a certain effect can be achieved by carrying out a standard mold-releasing treatment, for example, wherein said mold release agent composed of PVA is coated. However, it is desirable to carry out the following mold-releasing treatment, for example, in case of necessity of forming a high melting point sprayed metal layer in a considerable thickness. Such a mold-releasing treatment is preferably applied in case that a thickness of the high melting point sprayed metal layer is around 1–10 mm. Besides, the mold-releasing treatment as explained below can be applied not only in case of spraying a high melting point metal but also in case of spraying a low melting point metal.

As a mold release agent, inorganic particles having an average particle diameter of 0.05–20 μm dispersed in a volatile solvent, inorganic binder such as water glass or other dispersive media is used. A mold release agent containing only inorganic particles without a dispersive medium may be directly coated on the original mold surface. Inorganic particles commonly used in a high-temperature lubricant or ceramic molding are available, specifically, for example, metal oxide such as ferric oxide, alumina, silica, zirconia, titanium oxide, or nickel, chromium, stainless steel, silicon carbide, silicon nitride or graphite. Inorganic particles having an uneven anomalous external form has better adhesion of the sprayed metal layer than the ones having a smooth spherical external form. Therefore, pulverized red iron oxide is more suitable than sphere type red iron oxide (ferric oxide) used for paint.

The mold release agent can be obtained by dispersing the above inorganic particles into water glass. The ratio of the inorganic particles is 20–200 parts by weight to 100 parts by weight of water glass. When the inorganic particles constitute less than 20 parts by weight, uneven structure required for adhering of the high melting point sprayed layer is not sufficiently formed on the surface of a mold release agent coated on the secondary mold, so that the high melting point sprayed metal layer may peel off, not adhering sufficiently. When the inorganic particles exceeds 200 parts by weight, it brings difficulty in coating the mold release agent uniformly. Also, it causes poor fixation of the inorganic particles to the secondary mold by water glass and the mold release agent layer may peel off by the shock of metal spraying. As a result, the sprayed metal has poor adhesion.

The mold release agent is coated on the surface of the secondary mold by standard coating means such as brush or spray coating. In order to increase operation efficiency of coating, dilution of the mold release agent with water or alcohol is desirable.

The mixture of inorganic particles having average particle diameter of 0.1–20 μm (the first inorganic particles) and 0.05–5.0 μm (the second inorganic particles) is effective in improving adhesion of the high melting point sprayed metal layer and reproducing the finely rugged surface pattern of the secondary mold precisely on the sprayed metal layer surface. In order to enhance the above effect, it is more desirable that the average particle diameter of the second inorganic particle is twice that of the first inorganic particle or more in order to display the above-mentioned effect well. Furthermore, it is desirable that the average particle diameter of the first inorganic particles is 2.0– 20 μm and that the average particle diameter of the second inorganic particles is 0.05–2.0 μm. As the first inorganic particles, ferric oxide or nickel is preferable and the mixed particles of them may be also used. As the second inorganic particles, the scaly ones can display better properties than the spherical ones. As the scaly inorganic particles, boron nitride or graphite is preferable and both of them may be jointly used as well.

The following procedure is also adoptable as a releasing treatment. That is, liquid containing inorganic particle having relatively large average particle diameter of 0.1–20 μm dispersed in water glass is applied to the surface of the secondary mold as stated above. After that, relatively small inorganic particles having an average particle diameter of 0.05–2.0 μm is laminated on the above inorganic particle layer. The small diameter inorganic particles are sprayed as powder by means of air spray device, or sprayed with inorganic particles dispersed in volatile solvent having a low boiling point.

The thickness of the mold release agent layer on the surface of the secondary mold is preferable 1–100 μm, particularly 3–20 μm when a finely rugged pattern is required to be transferred.

After applying the mold releasing treatment to the secondary mold, high melting point metal is sprayed by the commonly used metal spraying method with devices such as a flame spray gun, an arc spray gun, or a plasma spray gun. However, said cold metal spraying method is not desirable because the high melting point sprayed metal layer cannot have enough adhesion to transfer the finely rugged pattern. In view of this invention, the arc spray is the most preferable to increase efficiency and reduce heat damage to the secondary mold coated with the low melting point sprayed metal layer.

Regarding high melting point metal, any metal of which melting point is 1,000° C. or higher and suitable for metal spraying is usable, for example, simple metal substance such as nickel, copper, iron, chromium or titanium, or alloy, containing said metal as a main component, such as the stainless steel, nickel-chrom, monel, cupro-nickel, low brass or aluminous bronze. The high melting point sprayed metal is used, which has characteristics such as hardness, abrasion resistance, erosion resistance or heat resistance, according to function or a use of the composition.

The thickness of the high melting point sprayed metal layer depends on the use of the composition, when only the shiny appearance of the metal is required, 25–200 μm is sufficient. In the case where high durability or abrasion resistance is required such as a mold, 500 μm–50 mm is preferable. The low melting point metal may be sprayed at the back side of the high melting point sprayed metal layer. The low melting point metal layer giving less heat damage to the secondary mold during metal spraying can be sprayed quickly and abundantly. Therefore, in order to increase operation efficiency without reduction of the function or efficiency, the low melting point metal layer may be laminated after coating the high melting point metal layer till the thickness is enough to optimize surface characteristics.

After coating the high melting point sprayed metal layer reinforcing resin layer such as FRP is applied to the back side thereof, the reinforcing resin layer may be prepared with the same producing procedure and material as the reinforcing layer for the secondary mold. However suitable materials or producing method should be selected according to a use or the functions of the composition containing the reinforcing layer. For example, when the composition is a mold, copper pipe or an electric heater installed in the reinforcement layer optimizing temperature or resin layer containing metal particle to increase the thermal conductivity of the mold is added to the peripheral surface or the inside of the reinforcing resin layer.

The reinforcement resin layer can be hardened by means of hardening effect by hardener, heat, radioactivity or the like. When the reinforcement layer is hardened, the high melting point sprayed metal layer and the reinforcement resin layer can be released from the secondary mold. Thus the composite product comprising the high melting point sprayed metal layer and the reinforcement resin layer is obtained. If the mold release agent or the low melting point sprayed metal layer is left on the high melting point sprayed metal layer, the cleaning treatment of the surface in the standard transfer process is adoptable.

The obtained composition has the same surface pattern on the high melting point sprayed metal layer as the primary mold, particularly the finely rugged pattern is reproduced precisely. Thus the composition is available as it is as a final product, but, if necessary, the composition can be finished with polishing or plating at a part of the surface.

The thus obtained composition is freely utilized in various uses such as a mold, works of art, ornaments, machine parts or construction materials in place of resin products having sprayed metal layer which were previously used. When it is used as a mold, HLU or a pair of cone/cavity type mold for casting, RTM, or injection is available.

The primary mold having the same surface pattern as a composition to be produced is easily produced by commonly used producing method for various original molds. The primary mold may be made of material such as resin, gypsum or wood which can be readily processed so as to produce the surface pattern such as the finely rugged pattern or the like. Other natural materials are also available as they are.

Also, utilizing said primary mold, the secondary mold having the sprayed metal layer consisting of the low melting sprayed metal on the surface which has a pattern transferred from the primary mold is easily and efficiently formed under the well known normal conditions. The soft layer of the low melting point metal can stick to the original mold along the surface pattern to precisely transfer the finely rugged pattern of the original mold's surface. The thickness of the low melting point metal layer of the secondary mold can be reduced so long as the metal layer precisely transfers the surface pattern. The rear side can be reinforced by cheap and light material such as synthetic resins. Thus obtained secondary mold is easily made, cheap in cost and portable in comparison with a secondary mold casted by low melting point metal.

When the metal which has a high melting point of 1,000° C. or higher having poor adhesion is sprayed on the above stated resin, gypsum or the like, it is impossible to obtain superior sprayed metal layer and to transfer the finely rugged pattern of the original mold. Especially when a sprayed metal of high temperature adhere to the original surface which is not so strong, thermal stress in the cooling process of the sprayed metal may break the original surface not to transfer finely rugged pattern or prevent adhesion of high melting point sprayed metal layer.

However, when high melting point metal is sprayed on the secondary mold surface made of a low melting point sprayed metal layer, high melting point metal readily attaches to the surface of the low melting point metal layer formed by metal spraying, so that a satisfactory layer can be formed.

That is, in the metal spraying method, metal particle or small block in layers. Therefore, there is a lot of minute void in the surface structure of the low melting point sprayed metal layer. When the high melting point metal is sprayed on the surface of the low melting point sprayed metal layer, a part of high melting point metal goes in the above mentioned minute void in the low melting point sprayed metal layer, so the high melting point metal is securely fixed. The low melting point metal layer which has a thermal expansion coefficient relatively close to that of the high melting point metal reduces thermal stress and resists the heat occured at the spraying of the high melting point metal layer. A part of the reinforcing layer gets in the above mentioned minute void of the sprayed metal particle, so that the reinforcing layer and the low melting point sprayed metal layer can be joined firmly. Therefore even if thermal stress is generated during spraying of high melting point metal, the low melting point sprayed metal layer does not peel off the reinforcing layer.

Furthermore, relatively soft low melting point metal is so readily deformed that the high melting point metal layer is easily released. If the surface of the secondary mold is harder than that of the high melting point metal layer, it is difficult to maintain the reproduced finely rugged pattern as high melting point metal layer may be easily deformed or broken. Even if the low melting point metal layer is partly left on the surface of the high melting point metal layer, it is rather easy to remove afterwords by a common method such as acid cleaning.

Thus produced composition comprising high melting point metal layer and reinforcing resin layer has the same surface pattern as the primary mold on the high melting point sprayed metal layer that is the original, particularly the same finely rugged pattern is precisely reproduced. According to the present invention, even the complicated irregular pattern of natural materials which cannot be produced by mechanical cutting processing is easily obtained. Like the forementioned prior art, in the method comprising carrying out blast processing on the original mold surface, even if a composition having a high melting point sprayed metal layer can be produced, uniform unevenness is formed on the composition surface. Therefore, there arises the necessity of making pattern on the metal layer of the composition surface by hand-engraving, etching, etc. after the composition is produced. It requires very high technology to carry out such pattern making, and its finishing becomes subtly different between the compositions.

However, according to the present invention, owing to the forementioned workings, uniform compositions having the very same pattern as the original mold's finely rugged pattern can be produced securely and efficiently. Specifically, in the present invention, even the finely rugged pattern of 50 μm or less in height/depth and 50 μm or less in width can be precisely reproduced in the very same pattern as that of the primary mold. Therefore, in the present invention, if specular surface exists on the primary mold surface, excellent specular surface is formed on the composition surface as well.

If once a plurality of secondary molds are made from the primary mold, large amount of compositions are produced more efficiently by utilizing each secondary mold obtained. In the case where the primary mold is directly used as a mold for final products, the span of the original is shortened due to wear and tear. However, according to the present invention, the primary mold is only used for making the secondary mold with easily treated low melting point metal. Therefore, the primary mold can be kept from wear and tear to extend the span drastically. Since the secondary mold can be made further more easily and cheeply in comparison with a casting mold, the secondary molds damaged by spraying of a high melting point metal can be replaced one after another without much trouble or expense.

When the high melting point sprayed metal layer is formed on the secondary mold, a mold release agent containing inorganic particles of average particle diameter 0.05–20 μm is preferable to improve adhesion of the high melting point metal sprayed layer and to reproduce the finely rugged pattern precisely. The reason is considered as follows;

A mold release agent applied to the original mold improves adhesion of high-melting point metal sprayed layer by squeezing the high melting point metal into gaps between inorganic particles existing in the mold release agent layer of the original. Therefore, the surface having extreme unevenness of a large amount of inorganic particles improves adhesion of high melting point metal. While a pitch of finely rugged pattern on the surface of the secondary mold is ordinary 50–1,000 μm, inorganic particles which is sufficiently smaller than the pitch can transfer the finely rugged pattern precisely without deformation of the pattern. Hence, the inorganic particles of average particle diameter 0.05–20 μm is preferable to improve adhesion of high melting point metal without deforming the finely rugged pattern.

In using the inorganic particles of relatively large average particle diameter of 2.0–20 μm for mold release agent (as the first particle) and relatively small average particle diameter of 0.05–2.0 μm (as the second particle) jointly, adhesion of high melting point metal and reproduction of the finely rugged pattern is improved more. The inorganic particle of average particle diameter of 0.05–20 μm is suitable for improving above effect, but scattering of distribution of inorganic particles or void may be generated in the layer of the mold release agent when only one kind, especially relatively large inorganic particles only are used.

The high melting point sprayed metal cannot adhere securely to the spot having no or few inorganic particle. If the first inorganic particles of a relatively large average diameter are used together with the second inorganic particles of a relatively small diameter, the small particles fill up the gaps between the large particles to provide inorganic particles uniformly all over the layer of the mold release agent and to attract the high melting point sprayed metal securely.

As shown in the above, when the smaller inorganic particle of 0.05–2.0 μm is used alone, uneven surface on the mold release agent layer is not enough to attract high melting point metal securely in comparison with the joint use of two kinds of particles.

In using the two kinds of particles jointly, separate coating in two steps is preferable to provide the larger first and smaller second particles uniformly all over the surface of the secondary mold. The smaller secondary particles filling up the gaps between the larger primary particles improve adhesion of the high melting point metal.

As previously mentioned, according to the present invention providing a composition having a sprayed metal layer, a method for producing thereof, and a mold release agent used in the producing method, a composition essentially consisting of high melting point sprayed metal layer and a reinforcing resin layer can be produced securely and efficiently. Also, the surface pattern such as the finely rugged pattern, specular surface, etc. formed on the primary mold being an original production mold is precisely reproduced on the surface of the high melting point metal sprayed layer.

As the result, the composition has characteristics of high melting point sprayed metal layer such as superior abrasion resistance or toughness as well as beautiful appearance resulting from the finely rugged pattern etc. This composition is suitable for various uses requiring both surface durability and precise surface pattern such as a mold or flooring panels. When the product is used in works of art or ornaments, it provides both beautiful design of the finely rugged pattern etc. and hard surface having damage resistance.

Furthermore, the primary mold is used only for making the secondary mold having low melting point sprayed metal layer which is relatively easily treated. Therefore, if once a plurality of the secondary molds are made, the first mold can be available for a long time and the span is expanded drastically, while producing large amount of compositions by the second molds. The objects and features of the invention may be understood with reference to the following detailed descroption of an illustrative embodiment of the invention, taken together with the accompanying drawings.

BRIEF DESCRIPTION OF THE DRAWINGS

FIG. 1 shows a schematic sectional and enlarged view illustrating the first stage in producing an embodiment of this invention, FIG. 2 shows a schematic sectional and enlarged view illustrating the second stage of the above process.

FIG. 5 shows a schematic sectional and enlarged view illustrating the fifth stage of the above process, FIG. 6 shows a schematic sectional and enlarged view illustrating the sixth stage of the above process, FIG. 9 shows a schematic sectional view illustrating a surface of a composition, FIG. 10 shows a schematic sectional view illustrating a use of the composition, and FIG. 11 shows a schematic sectional and enlarged view illustrating the surface of the secondary mold coated with a mold-release agent.

DETAILED DESCRIPTION OF THE INVENTION

Figure 3A:
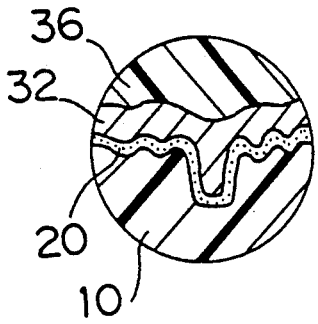
FIG. 3 shows a schematic sectional and enlarged view illustrating the third stage of the above process.

Turning now descriptively to the drawings, in which similar reference characters denote similar elements throughout the several views, FIGS. 1–9 show schematic views explaining producing process of the composition having sprayed metal layer step by step.

As shown in FIG. 1, a primary mold 10 having finely rugged pattern on its surface is made from resins or the like.

As shown in FIG. 2, a mold-release agent 20 consisting of an aqueous PVA solution or the like is applied to the surface of the primary mold 10. The mold-release agent layer 20 is thinly formed along the finely rugged pattern of the primary mold 10. On the releasing agent layer 20, a layer 32 of low melting point metal such as Zn is sprayed by a spraying nozzle 40. The low melting point sprayed metal layer fill up the finely rugged pattern of the primary mold 10.

Figure 3:
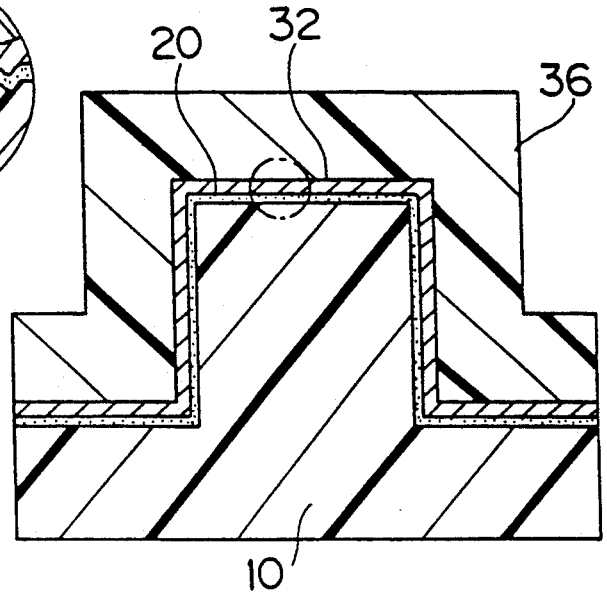
Figure 4A:
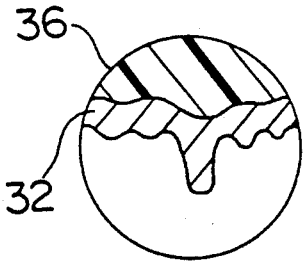
FIG. 4 shows a schematic sectional and enlarged view illustrating the fourth stage of the above process.
Figure 4:
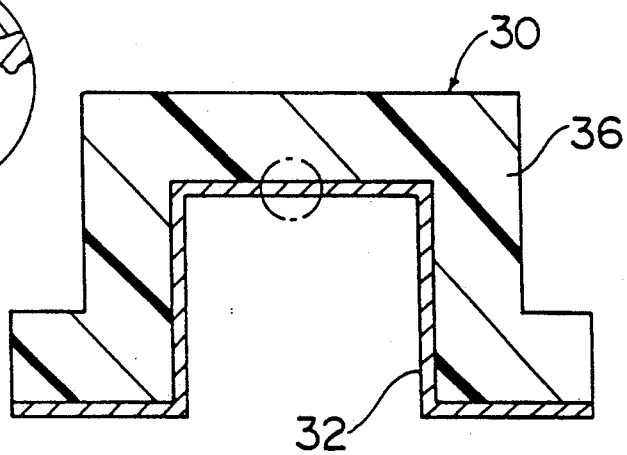

As shown in FIG. 3, a reinforcing layer 36 comprising FRP is formed on the low melting point sprayed metal layer 32. After the reinforcing layer 36 is hardened, as shown in FIG. 4, a composition 30 of reinforcing layer 36 and low melting point sprayed metal layer 32 is released from the primary mold 10. This composition 30 is utilized as a secondary mold. The finely rugged pattern of the primary mold 10 is precisely transferred to the surface of the low melting point sprayed metal layer 32.

As shown in FIG. 5, a releasing agent 50 mainly comprising red iron oxide dispersed in glass water is coated on the surface of low melting point sprayed metal layer 32 of the secondary mold 30. This mold release agent 50 should be thinly applied along the finely rugged pattern of the low melting point layer 32.

As shown in FIG. 6, a layer 62 of high melting point metal such as Ni or the like is sprayed on the surface of the releasing layer 50 by the above mentioned spraying nozzle 40. The high melting point metal layer 62 may fill up the finely rugged pattern of the surface of the secondary mold 30.

Figure 7A:
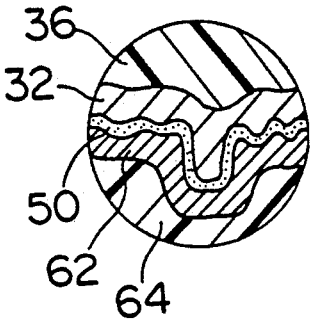
FIG. 7 shows a schematic sectional and enlarged view illustrating the seventh stage of the above process.
Figure 7:
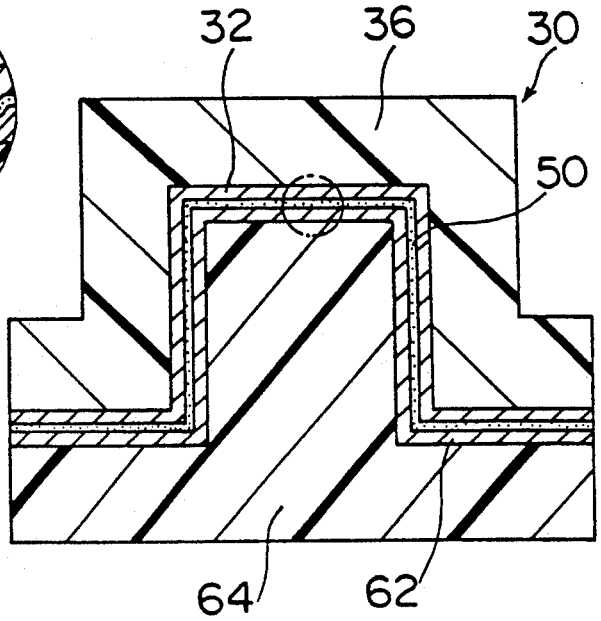
Figure 8A:
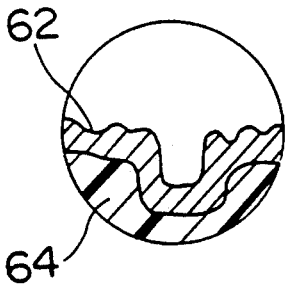
FIG. 8 shows a schematic sectional and enlarged view illustrating the eighth stage of the above process.
Figure 8:
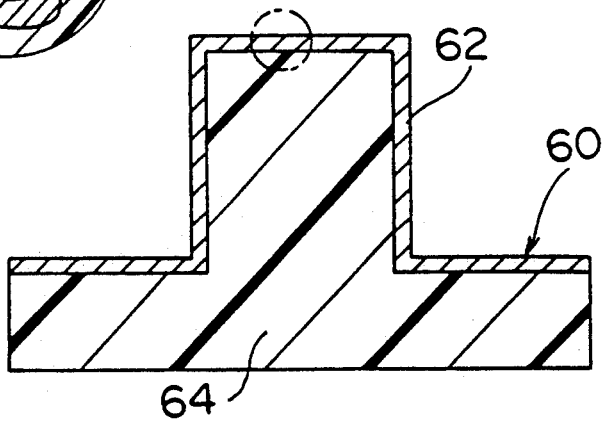

As shown in FIG. 7, a reinforcing resin layer 64 comprising FRP such as glass fiber reinforced epoxy resin is formed at the back surface of the high melting point sprayed metal layer 62. After hardening the reinforcing resin layer 64, as shown in FIG. 8, a composition 60 comprising of the reinforcing resin 64 and the high melting point sprayed metal layer 62 is released from the secondary mold 30. Thus formed composition 60 is utilized as a final product. On the surface of the high melting point sprayed metal layer 62, the finely rugged pattern of the primary mold 10 is precisely reproduced.

FIG. 9 shows a shematic enlarged view of the surface structure of the composition 60. On the surface of the high melting point sprayed metal layer 62, various patterns 66, 67 and 68 are formed. The thickness of the high melting point metal layer 62 is kept evenly in spite of rugged pattern of 66, 67 and 68. When rugged pattern is made by machining or etching treatment, the thickness of the metal surface may be partly reduced. Especially, a concave equal to or deeper than the thickness of the high-melting point metal layer 62 such as a groove 67 cannot be made by the above machining or etching treatment. Also, it is easy to form a projection 68 on the surface of the high melting point sprayed metal layer 62. Machining or etching treatment for the projection 68 is troublesome and uneconomical.

FIG. 10 shows a use of thus made composition 60 as a pair of cone/cavity type mold. The cone type mold 60*a* is made in the above producing process shown in FIGS. 1-9. The cavity type mold 60*b* can be made in the very same process as the cone type mold 60*a* except the concave surface. Molding resin is filled in the cavity 70 being formed between the cone type mold 60*a* and the cavity type mold 60*b* to make plastics according to the shape of the cavity 70. Inside of the cone type mold 60*a* or the cavity type mold 60*b*, pipes for heating, heaters, a opening for supplying the molding resin to the molds, and other operational parts may be installed. Drawings illustrating these constructions are omitted as well known procedures are adoptable.

Next, FIG. 11 shows a schematic view explaining functions of the mold-release agent 50 coated on the surface of low melting point sprayed metal layer 32 of the secondary mold 30 in the case where the two kinds inorganic particles with different diameters are used jointly. In the low melting point sprayed metal layer 32, metal particles 33 is laminated with minute gaps to each other. When the high melting point metal is sprayed, it gets into the gaps between metal particles and improve adhesion. Also the reinforcement resin layer 36 at the back side of the low melting point metal layer 32 get into the gaps of the metal particle 33 to increase the bond strength.

The mold release agent layer 50 is comprised of red iron oxide 52 dispersed in water glass 54 on the low melting point sprayed metal layer 32, and the boron nitride 56 powder which is smaller than red iron oxide in diameter is sprayed on the red iron oxide. The red iron oxide 52 is angular shaped powder. The red iron oxide 52 is set along the surface of each metal particle 33 in the low melting point sprayed metal layer 32 with water glass 54 as adhesive. The gaps between the red iron oxide 52 are filled up with boron nitride 56. As the result, whole surface of the low melting point sprayed metal layer 32 is covered with the red iron oxide 52 or the boron nitride 56.

Thus if the mold release agent layer 50 is formed in the state as mentioned above, when the high melting point metal is sprayed on the layer 50, the high melting point sprayed metal securely adheres while entrenching uneven pattern of the red iron oxide 52. Even in the gaps between the red iron oxide 52, the boron nitride 56 presenting uneven surface securely attracts the high melting point sprayed metal. Therefore, adhesion of the high melting point sprayed metal layer 60 is improved all over the mold release agent layer 50.

The following examples may be conseidered as exemplary of the invention:

EXAMPLE 1

A mold for producing an artificial marble composition 1.100×1,100 mm in casting method is formed. The artificial marble is utilized as flooring panels for such as a bath room including joints and tiles.

The primary mold is made of wood matching to the construction of the above mold, wherein the tile portion is covered with molded FRP sheet to which the surface pattern of natural stone have been transferred.

To the surface of said primary mold, a mold release agent (EP-11 PVA aqueous solution, trade name: made by NIPPON SHOKUBAI Co., Ltd.) is sprayed. Next, a low melting point metal layer is formed till the thickness reaches 100 μm by spraying Zn wiring (diameter 1.6 mm) with a arc spraying gun (8830 gun, trade name: made by TAFA).

The FRP layer comprising unsaturated polyester resin (EPOLAC, N-350YT trade name: made by NIPPON SHOKUBAI Co., Ltd.) and reinforcing fiber (MC 450A glass fiber, trade name: made by NITTOH BOHSEKI KK) is formed at the back side of the low melting point metal layer as a reinforcement layer. After the reinforcing layer is hardened, the secondary mold comprising low melting point sprayed metal layer and reinforcing layer is released from the primary mold.

To the surface of Zn layer of the secondary mold, liquid containing 100 parts by weight of pulverized red iron oxide (average diameter 5 μm) dispersed in 100 parts by weight of water glass is thinly coated so that the foundation can be seen. In order to spray easily, said dispersed liquid is diluted by water. The red iron oxide dispersed liquid is dried, boron nitride (average diameter 0.8 μm) is sprayed till the red color of the red iron oxide disappear. Thus sprayed surface presents white color. Nickel wiring (diameter 1.6 mm) is sprayed to a 1 mm thickness by the arc spraying gun (8830 gun, trade name: made by TAFA) to form high melting point metal layer.

At the back side of the high melting point sprayed metal layer, reinforcement resin layer comprising FRP which is the same as that of the above secondary mold is formed with the Cu pipe in the reinforcement resin layer.

After the reinforcing resin layer is hardened, the composite product comprising high melting point metal layer and reinforcing resin is released from the secondary mold.

Thus formed composition is utilized as a mold to produce flooring panels. Excellent 50 panels are molded by using a molding material comprising 100 parts by weight of unsaturated polyester resin (EPOLAC MR-500, trade name: made by NIPPON SHOKUBAI Co., Ltd.) and 200 parts by weight of aluminium hydroxide (HIGILITE H-100, trade name: made by SHOWA DENKO KK) without any problem. The precise pattern of original stone is reproduced on the flooring panels.

COMPARISON 1-1

The procedure of EXAMPLE 1 is repeated with the difference that Nickel is replaced by Zn-Al alloy which is low melting point metal as sprayed metal to form a composition, that is a mold. With the mold thus obtained, the flooring panel similar to that of EXAMPLE 1 is produced. However, a part of the sprayed metal layer comprising the pattern of original stone has peeled off after the fourth panel is produced.

COMPARISON 1-2

The procedure of EXAMPLE 1 is intended with the difference that the secondary mold comprising only polyester resin layer is utilized in stead of the secondary mold having both low melting point sprayed metal layer and polyester resin layer. However, nickel that is a high melting point metal does not adhere to the surface of the secondary mold consisting of only polyester resin layer coated with a mold-release treatment, and high melting point metal layer cannot be formed.

COMPARISON 1-3

The procedure of EXAMPLE 1 is repeated to produce a composition, after the blast treatment is applied to the secondary mold comprising only polyester resin layer made in COMPARISON 1-2. In this case, high melting point metal layer comprising nickel can be formed, but the pattern of original stone cannot be reproduced when the composition is utilized to produce flooring panels such as EXAMPLE 1.

EXAMPLE 2

The procedure is for Buddihist altar fittings. The main part of this fittings is made of polyester resin and covered with copper. The composition of the EXAMPLE 1 is basically repeated. The size of the first mold is 200×150×400 mm and treated in accordance with the outer shape of the fittings. The secondary mold having low melting point metal layer comprising Zn is formed in the same procedure of the EXAMPLE 1. After applying releasing treatment to the secondary mold, pure copper is sprayed as high melting point metal to form sprayed Cu layer of about 30 μm thickness. Into the back side of this sprayed Cu layer, a molding material comprising 100 parts by weight of unsaturated polyester (EPOLAC MR-600, trade name: made by NIPPON SHOKUBAI Co., Ltd.) and 100 parts of aluminium hydroxide (HIGILITE, trade name: made by SHOWA DENKOH KK) is poured and hardened. After 40 minutes, a composition comprising sprayed Cu layer and polyester resin layer is released from the secondary mold. The obtained composition, that is Buddihist altar fittings presents beautiful appearance and grain pattern of the first mold is precisely reproduced at the surface of the sprayed Cu layer.

COMPARISON 2-1

The procedure of EXAMPLE 2 is repeated with the difference that a secondary mold of FRP made of polyester resin is produced instead of the secondary mold having a low melting point sprayed metal layer comprising Zn. After applying blast treatment to the FRP surface of the secondary mold, the procedure is intended under the same condition of EXAMPLE 2 to form a high melting point metal layer comprising Cu. A sprayed layer of Cu is formed on the FRP surface and a product similar to that of EXAMPLE 2 is obtained. But the grain pattern is not transferred to the product surface and it is a non-uniform coarse surface.

Hence obvious changes may be made in the specific embodiment of the invention described herein, such modifications being within the spirit and scope of the invention claimed, it is indicated that all matter contained herein is intended as an illustrative and not as limiting in scope.

What is claimed is:

1. A method for producing a composition consisting essentially of a metal layer made by metal spraying and a resin layer which reinforces said metal layer comprising:

making a primary mold having a surface pattern which is a positive pattern of the surface of the finished molded composition;

applying a first mold release agent on the surface of the primary mold;

spraying a low melting point metal onto the primary mold surface to make a low melting point sprayed metal layer;

reinforcing the low melting point sprayed metal layer to make a secondary mold comprising the low melting point sprayed metal layer and the reinforcing substance;

releasing from the primary mold the secondary mold having the negative surface pattern of the primary mold on the low melting point metal;

applying a mold-releasing treatment on the surface of the secondary mold, wherein the mold-releasing treatment involves the application of a second mold release agent containing inorganic particles having an average particle diameter of from 0.05 to 20 μm on the surface of the secondary mold;

spraying a high melting point metal having a melting point of 1,000° C. or higher onto the secondary mold surface;

applying a reinforcing resin layer to the high melting point sprayed metal layer;

hardening said resin layer; and releasing the finished molded composition consisting essentially of the high melting point sprayed metal layer and the reinforcing resin layer from the secondary mold.

2. The method of claim 1, wherein the inorganic particles are a mixture of:

first inorganic particles having an average particle diameter of from 0.1 to 20 μm and selected from the group consisting of ferric oxide, nickel and mixtures thereof; and second inorganic particles having an average particle diameter of from 0.05 to 5 μm and selected from the group consisting of boron nitride, graphite and mixtures thereof, and further, an average particle diameter of said first inorganic particles being at least twice that of the second inorganic particles.

3. The method of claim 2, wherein the mold-releasing treatment for the secondary mold involves applying a water glass solution dispersed and suspended with the first inorganic particles consisting of ferric oxide, nickel or mixture thereof having an average particle diameter of from 2.0 to 20 μm on the surface of the secondary mold, attaching the second inorganic particles consisting of boron nitride, graphite or mixtures thereof having an average particle diameter of from 0.05 to 2.0 μm to the water glass.

* * * * *